US006842927B2

(12) United States Patent
England

(10) Patent No.: US 6,842,927 B2
(45) Date of Patent: Jan. 18, 2005

(54) MATTRESS

(75) Inventor: Rodney England, New Tazewell, TN (US)

(73) Assignee: England, Inc., New Tazewell, TN (US)

( * ) Notice: Subject to any disclaimer, the term of this patent is extended or adjusted under 35 U.S.C. 154(b) by 0 days.

(21) Appl. No.: 10/379,090

(22) Filed: Mar. 4, 2003

(65) Prior Publication Data

US 2004/0172765 A1 Sep. 9, 2004

(51) Int. Cl.[7] ..... A47C 17/00
(52) U.S. Cl. ..... 5/739; 5/729; 5/727; 5/717
(58) Field of Search ..... 5/716–718, 727, 5/729, 739, 720

(56) References Cited

U.S. PATENT DOCUMENTS

| | | | | |
|---|---|---|---|---|
| 18,585 A | | 11/1857 | Hersee | |
| 143,854 A | | 10/1873 | Smith et al. | |
| 179,257 A | | 6/1876 | Birk | |
| 293,486 A | | 2/1884 | Maynard | |
| 316,444 A | | 4/1885 | Burr | |
| 549,248 A | * | 11/1895 | O'Brien et al. | 5/696 |
| 908,273 A | * | 12/1908 | Karr | 5/716 |
| 912,855 A | | 2/1909 | King | |
| 1,192,510 A | | 7/1916 | Fischmann | |
| 1,474,080 A | | 11/1923 | King | |
| 1,619,916 A | | 3/1927 | Brewster | |
| 1,986,255 A | | 1/1935 | Durfey et al. | |
| 2,224,300 A | * | 12/1940 | Johnson | 5/716 |
| 2,469,596 A | | 5/1949 | Groom | |
| 2,605,099 A | | 7/1952 | Brown | |
| 2,904,329 A | | 9/1959 | Joseph | |
| 2,994,890 A | | 8/1961 | Wagner | |
| 3,055,021 A | * | 9/1962 | Rymland et al. | 5/716 |
| 3,608,107 A | | 9/1971 | Kentor et al. | |
| 3,732,586 A | | 5/1973 | Frey | |
| 3,779,537 A | | 12/1973 | Kalister | |
| 3,901,494 A | | 8/1975 | Sena | |
| 3,916,464 A | | 11/1975 | Tyhanic | |
| 3,981,033 A | * | 9/1976 | Toda | 5/717 |
| 4,154,786 A | | 5/1979 | Plasse et al. | |
| 4,788,731 A | | 12/1988 | Yokoi et al. | |
| 4,862,540 A | | 9/1989 | Savenije | |
| 5,027,459 A | * | 7/1991 | Perry, et al. | 5/721 |
| 5,063,625 A | | 11/1991 | Perry | |
| 5,165,125 A | | 11/1992 | Callaway | |
| 5,222,264 A | * | 6/1993 | Morry | 5/718 |
| 5,239,715 A | | 8/1993 | Wagner | |
| 5,461,737 A | * | 10/1995 | Ikeda et al. | 5/716 |
| 5,469,590 A | | 11/1995 | Simon | |
| 5,687,439 A | | 11/1997 | Wagner | |
| 5,832,551 A | | 11/1998 | Wagner | |
| 5,924,681 A | | 7/1999 | Bullard | |
| 6,186,483 B1 | | 2/2001 | Bullard | |
| 6,272,706 B1 | * | 8/2001 | McCune et al. | 5/720 |

FOREIGN PATENT DOCUMENTS

| | | |
|---|---|---|
| DE | 887863 | 8/1953 |

* cited by examiner

*Primary Examiner*—Teri Pham Luu
(74) *Attorney, Agent, or Firm*—Harness, Dickey & Pierce, P.L.C.

(57) ABSTRACT

A crowned mattress having an inner spring unit with a plurality of spring members, a foam layer, and a cover. Peripheral edges of the inner spring unit are compressed together by compression members to provide a crowning or bowing of the inner spring unit that is translated into a crowning of the mattress. The foam layer can also be crowned to provide additional crowning. Spring members within inner spring unit can be reinforced by resilient members to increase an effective spring rate of a reinforced spring member. Reinforced spring members are dispersed throughout the inner spring unit in a desired pattern.

23 Claims, 3 Drawing Sheets

MATTRESS

FIELD OF THE INVENTION

The present invention relates generally to mattresses and, more specifically to mattresses in which a crowned shape is provided.

BACKGROUND OF THE INVENTION

To provide a desirable appearance over their useful life, mattresses should avoid having a depression therein in the central portion of the mattress. In order maximize the desirability of that appearance, mattresses should at a minimum appear flat or more preferably have a slightly crowned shape. In the latter case, mattresses maybe configured so that a central portion of the mattress is higher than the end portions resulting in a crown of the mattress in the central portions. These crowned mattresses typically employ a wire frame having two substantially flat and parallel planes with a plurality of spring members disposed between the two planes. One or more layers of resilient material, such as foam, are placed on the planes. The foam layers may be tapered such that they are thicker in the middle and thinner as they extend outwardly toward the peripheral edges. This configuration causes the middle section of the foam to be thicker than around the edges and provides a crowning of the mattress. The resilient material can be configured so that the mattress crowns between peripheral edges that define the length of the mattress and/or crowns between peripheral edges that define a width of the mattress.

Loading on a mattress (by a person sitting or lying on the mattress) is usually located in a central portion of the mattress and is not concentrated along or adjacent to the peripheral edges of the mattress. That is, the central portion of the mattress over time will experience the most loading and, as a result, experience the most compression. Over time, this concentrated loading in the central portion of the mattress may result in diminished comfort in the central portion and may cause the resilient material in the central portion to break down. With the loading concentrated in the central portion, it is desirable that the central portion provide the most comfort for a user of the mattress along with being capable of supplying the comfort level over the lifespan of the mattress.

As the mattress gets used, the loading causes the resilient material to break down, especially in the central portion, and the crowning effect is diminished. After a period of usage, the crowning effect is so diminished that an undesirable appearance of the mattress occurs. Specifically, the breaking down of the resilient material may result in a depression in the mattress that provides an undesirable appearance. Additionally, the spring members in the central portion of the mattress may also exhibit a loss of resiliency and contribute to the formation of a depression. This undesirable appearance is especially problematic in the hospitality industry where the appearance of the mattress is important to customer satisfaction. As a result of the undesired appearance, the hospitality industry typically replaces the mattress.

The breaking down of the resilient material and the onset of a depression, however, typically occurs prior to the end of the useful life of the mattress. In other words, the crowning effect is lost and the undesirable appearance occurs prior to the end of the useful life of the mattress. Thus, the hospitality industry replaces the mattress due to the undesirable appearance prior to the end of the useful life of the mattress. The replacing of the mattress due to the undesirable appearance prior to the end of the useful life is expensive. Such replacement not only comprises the cost of a new mattress, but also the cost of labor in installing a new mattress and removing the old one as well as the cost of disposing of the old mattress.

Accordingly, it is advantageous to provide a crowned mattress that remains crowned for a prolonged period of time and does not rely solely upon the structural integrity of the resilient material to maintain the crowned appearance. Furthermore, it is also advantageous to reinforce the central portion of the mattress in order to increase the comfort and/or the longevity of the central portion of the mattress.

SUMMARY OF THE INVENTION

A mattress in accordance with the principals of the present invention provides a crowned shape that is not solely dependent upon the resilient material maintaining its resiliency to maintain the crowned shape. This increases the appearance lifespan of the mattress which in turn reduces the frequency at which the mattress must be replaced. The mattress also provides reinforced spring members throughout the central portion to increase comfort and increase the appearance lifespan.

A mattress in accordance with the principals of the present invention includes a cover forming an outer layer and frame that is at least partially enclosed in the cover. The frame includes first and second support members that each have a peripheral edge. The first and second support members are spaced apart with said peripheral edges being substantially aligned with one another. The first and second support members are bowed in at least one direction such that central portions of the first and second support members are spaced further apart than the aligned peripheral edges in the at least one direction. There are a plurality of spring members disposed between the first and second support members. The spring members resist compression of the first and second support members toward one another.

In another aspect according to the principals of the present invention a mattress includes a cover and a frame which is at least partially disposed in the cover. There are a plurality of spring members that are disposed in the frame. There are also a plurality of resilient members. Each resilient member is configured to engage with one of the spring members to alter an effective spring rate of that spring member. The resilient members are dispersed throughout a central portion of the frame with each resilient member engaged with a spring member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a cross-sectional view of the mattress of FIG. 1 along line 3—3;

DETAILED DESCRIPTION OF THE PREFERRED EMBODIMENT

The following description of the preferred embodiment is merely exemplary in nature and is in no way intended to limit the invention, its application, or uses.

Figure 1A:
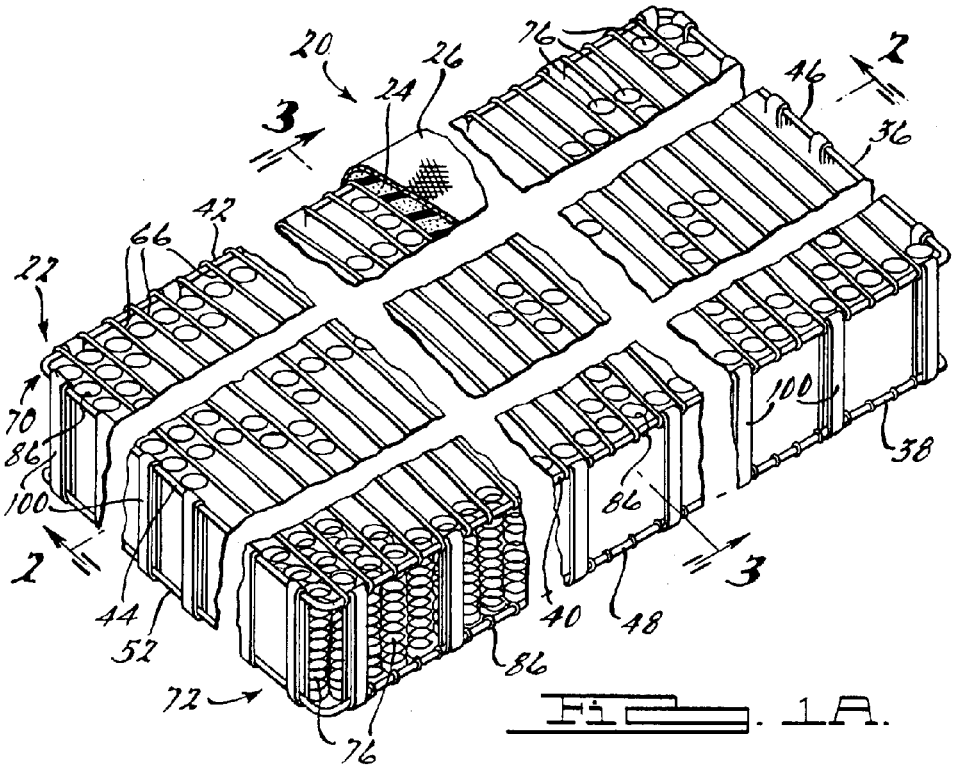
FIG. 1A is a cut-away perspective view of a preferred embodiment of a mattress according to the principals of the present invention.

Referring to FIG. 1A, a preferred embodiment of a mattress according to the principals of the present invention is illustrated and indicated as 20. It should be appreciated some aspects of the present invention are shown in exaggerated proportions for clarification purposes. Mattress 20 includes an inner spring unit 22, one or more foam padding layers 24 provided on top and bottom of inner spring unit 22, and a mattress cover 26 which encases inner spring unit 22 and foam padding layers 24.

Inner spring unit 22 includes a pair of conventional upper and lower border wires 36 and 38 that define upper and lower peripheral edges of inner spring unit 22. Upper and lower border wires 36 and 38 are generally rectangular in shape and spaced apart from one another. Upper border wire 36 has a pair of substantially parallel longitudinal sides 40 and 42 and a pair of substantially parallel lateral sides 44 and 46. Similarly, lower border wire 38 has a pair of substantially parallel longitudinal sides 48 and 50 and a pair of substantially parallel lateral sides 52 and 54. Longitudinal sides 40, 42, 48 and 50 of border wires 36 and 38 define a longitudinal length of inner spring unit 22 while lateral sides 44, 46, 52 and 54 of border wires 36 and 38 define a lateral width of inner spring unit 22. Upper and lower border wires 36 and 38 are spaced from one another and arranged so that longitudinal sides 40 and 42 of upper border wire 36 are substantially aligned with longitudinal sides 48 and 50 of lower border wire 38. Likewise, border wires 36 and 38 are arranged so that lateral sides 44 and 46 of upper border wire 36 are substantially aligned with lateral sides 52 and 54 of lower border wire 38.

Inner spring unit 22 includes a plurality of stringers or connecting rods 66 and 68 that extend laterally across inner spring unit 22. Stringers 66 extend between longitudinal sides 40 and 42 of upper border wire 36 while stringers 68 extend laterally between longitudinal sides 48 and 50 of lower border wire 38. In the embodiment shown, border wire 36, stringers 66 and the top ends of spring members 76 define a first support member 70 on which a foam padding layer 24 is positioned. Likewise, lower border wire 38, stringers 68 and the bottom ends of spring members 76 define a second support member 72 upon which a foam padding layer 24 resides. However, it should be appreciated that the components that define support members 70 and 72 will vary depending upon the specific method and configuration used to retain spring members 76 in position. Thus, support members 70 and 72 represent the top and bottom surfaces of inner spring unit 22 upon which foam padding layers 24 are positioned.

Figure 1B:
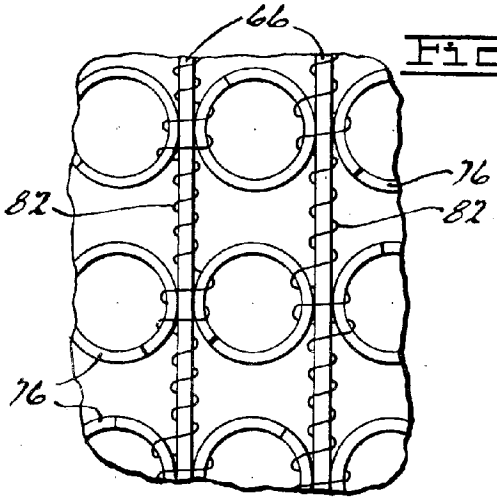
FIG. 1B is an enlarged partial view of a portion of the mattress of FIG. 1A.

A plurality of spring members 76 are disposed between first and second support members 70 and 72. Spring members 76 can take a variety of forms. For example, spring members 76 can be coil springs, as shown. One end of each spring member 76 is connected to upper border wire 36 and/or stringers 66 while opposite ends of each spring member 76 is connected to lower border wire 38 and/or stringers 68. Spring members 76 are connected to border wires 36 and 38 and stringers 66 and 68 in a conventional manner. For example, as shown in FIG. 1B, each of the stringers 66 and 68 has a helical wrap 82 spirally wound around it. The helical wrap 82 is wound around the upper most (or lower most) convolution of each spring member 76 of to the two rows of spring members 76 associated with each stringer 66 and 68 so that the spring members 76 are held in place. The peripheral rows of spring members 76 of inner spring unit 22 are secured to upper and lower border wires 36 and 38 via a number of clamps or connectors 86 (only some of which are shown in FIG. 1A). Spring members 76 are substantially identical and evenly spaced throughout inner spring unit 22. Spring member 76 resists compression between first and second support member 70 and 72. While spring members 76 are shown and described as being arranged between support members 70 and 72 with the use of stringers 66 and 68, helical wrap 82 and clamps 86, it should be appreciated that spring members 76 can be retained between border wires 36 and 38 in a variety of ways other than that disclosed, without departing from the scope of the present invention. For example, spring members 76 can all be positioned adjacent one another and clamped together by connectors or clamps 86 which are also used to connect spring members 76 along the periphery to the respective border wires 36 and 38. Additionally, the stringers can extend both laterally and longitudinally across both support members 70 and 72 to provide a grid to which spring members 76 can be attached. Thus, it should be appreciated that spring members 76 can be retained in place between border wires 36 and 38 in a variety of manners known in the art without departing from the scope of the present invention. Furthermore, while the stringers are shown as extending laterally across support members 70 and 72, single sets of stringers that extend longitudinally across support members 70 and 72 can also be used or a combination of both to provide a grid of stringers to which spring members 76 can be secured.

A plurality of compression members 100 connect the aligned sides of upper and lower border wires 36 and 38. Specifically, longitudinal sides 40 and 42 of upper border wire 36 are connected to longitudinal sides 48 and 50 of lower border wire 38 by a plurality of compression members 100 which are spaced apart along the longitudinal sides. Likewise, lateral sides 44 and 46 of upper border wire 36 are connected to lateral sides 52 and 54 of lower border wire 38 by a plurality of compression members 100 that are spaced apart along the lateral sides. Compression members 100 control a maximum distance upper and lower border wires 36 and 38 can be spaced from one another and are dimensioned to compress spring members 76 between first and second support members 70 and 72. That is, when mattress 20 is in its unloaded or relaxed state compression members 100 are under tension and act against spring members 76 to retain upper and lower border wires 36 and 38 in the maximum spaced relation.

Support members 100, as stated above, are dimensioned to be under tension and act against the resistance to compression of spring members 76 when mattress 20 is unloaded or relaxed. When mattress 20 is loaded, portions of inner spring unit 22 will be compressed and tension on compression members 100 may decrease or be eliminated. That is, due to edges of boarder wires 36 and 38 being compressed toward one another by a load on mattress 20, some of the compression members 100 may be slack. With the possibility that compression members 100 can be slack, it is preferred that compression members 100 be flexible so that compression members 100 can be slack without protruding beyond support members 70 and 72. To meet these needs, compression members 100 are preferably made from endless cloth strips that form a band around portions of upper and lower boarder wires 36 and 38. It should be appreciated, however, that compression members 100 can be made from other materials. For example, compression members 100 can be made from woven and non-woven material or other materials that do not have a high degree of stretch, such as ProPex® webbing available from Amoco Fabrics and Fibers Company of Atlanta, Ga.

Spring members 76, as stated above, resist compression between first and second support members 70 and 72 and, accordingly, resist compression of upper and lower border wires 36 and 38 toward one another. Spring members 76 exert a force on first and second support members 70 and 72 via upper and lower border wires 36 and 38 and stringers 66 and 68. The resistance to compression by spring member 76 causes first and second support member 70 and 72 to bow outwardly away from one another between upper and lower border wires 36 and 38, as described below.

Figure 2:
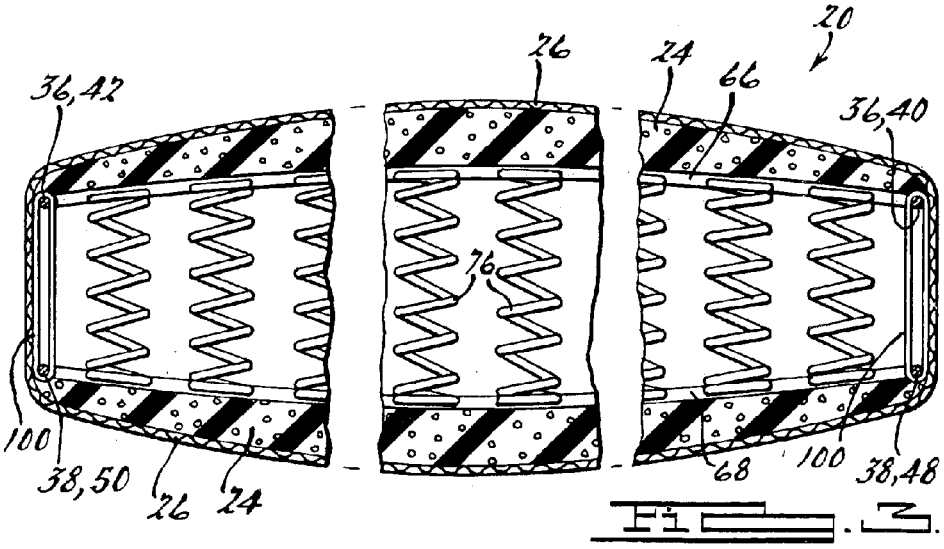
FIG. 2 is a cross-sectional view of the mattress of FIG. 1 along line 2—2.
Figure 2:
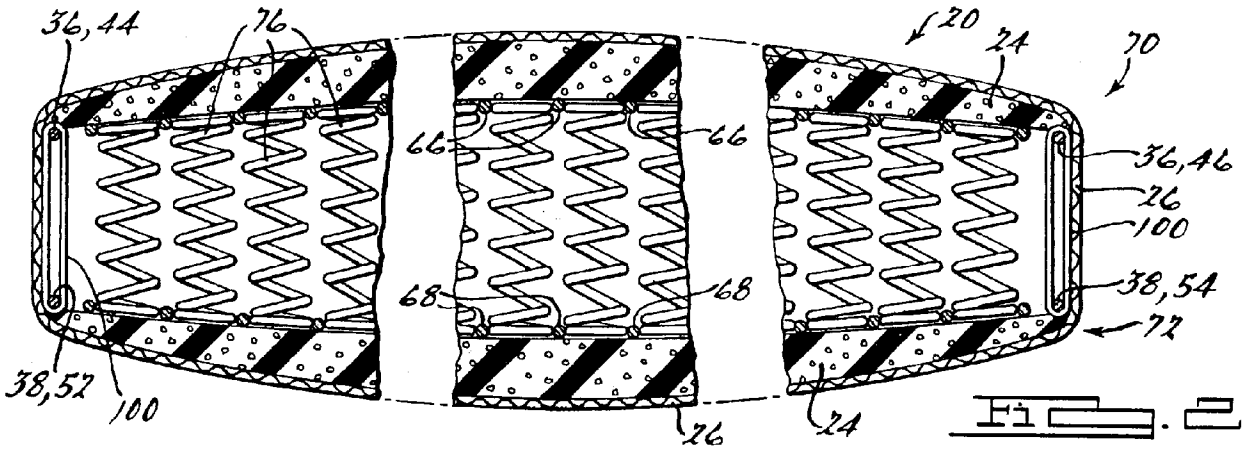

As can best be seen in FIG. 2, when compression members 100 are used to connect lateral sides 44 and 46 of upper border wire 36 to lateral sides 52 and 54 of lower border wire 38, first and second support members 70 and 72 bow away from one another as they extend from the lateral sides toward a central portion of inner spring unit 22 due to force applied by spring members 76. That is, the lateral edges of first and second support members 70 and 72 are maintained at the maximum spaced apart distance by compression members 100 while spring members 76 apply outward pressure on border wires 36 and 38 and stringers 66 and 68. With the lateral sides 44, 46, 52 and 54 of border wires 36 and 38 constrained by compression members 100, the distance between first and second support members 70 and 72 is smallest along the lateral sides and greatest in the central portion of inner spring unit 22. This results in a crowning of inner spring unit 22 between the lateral sides. The crowning of inner spring unit 22 translates into a crowning of mattress 20 between the lateral sides.

As can best be seen in FIG. 3, when compression members 100 are used to connect longitudinal sides 40 and 42 of upper border wire 36 to longitudinal sides 48 and 50 of lower border wire 38, first and second support members 70 and 72 bow away from one another as they extend from the longitudinal sides toward a central portion of inner spring unit 22 due to force applied by spring members 76. That is, the longitudinal edges of first and second support members 70 and 72 are maintained at the maximum spaced apart distance by compression members 100 while spring members 76 apply outward pressure on border wires 36 and 38 and stringers 66 and 68. With the longitudinal sides 40, 42, 48 and 50 of border wires 36 and 38 constrained by compression members 100, the distance between first and second support members 70 and 72 is smallest along the longitudinal sides and greatest in the central portion of inner spring unit 22. This results in a crowning of inner spring unit 22 between the longitudinal sides. The crowning of inner spring unit 22 translates into a crowning of mattress 20 between the longitudinal sides.

As shown in FIGS. 1–3, inner spring unit 22 has compression members 100 that connect both longitudinal and lateral sides of the upper and lower border wires 36 and 38. It should be appreciated that inner spring unit 22 can have compression members 100 along only the longitudinal sides or along only the lateral sides to provide bowing in a single direction without departing from the scope of the present invention. That is, inner spring unit 22 can be configured with compression members 100 connecting longitudinal sides 40 and 42 of upper border wire 36 to longitudinal sides 48 and 50 of lower border wire 38 to provide crowning only between the longitudinal sides while the lateral sides 44, 46, 52 and 54 of border wires 36 and 38 are not connected together by compression members 100 or vice versa to provide crowning of inner spring unit 22 only between the lateral sides without departing from the scope of the present invention. Thus, compression members 100 can be utilized to crown inner spring unit 22 between the longitudinal sides and/or the lateral sides. It should also be appreciated that such bowing or crowning can occur when using other methods (with or without stringers 66 and 68) to secure spring members 76 between border wires 36 and 38.

Foam padding layer 24, as can best be seen in FIGS. 2 and 3, has a thickness that varies to provide additional crowning of mattress 20. That is, foam member 24 has a maximum thickness in a central portion and tapers outwardly towards its peripheral edges so that a minimum thickness occurs along the peripheral edge. The foam padding layer 24 thereby provides additional crowning of mattress 20. If desired, the foam padding layer 24 can be configured to provide crowning in a single direction or in two directions. That is, if it is desired to provide a mattress 20 that only crowns between its longitudinal sides, compression members 100 can connect longitudinal sides 40, 42, 48 and 50 of border wires 36 and 38 and foam padding layer 24 can taper as it extends between the longitudinal sides. The crowning of foam padding layer 24 and of inner spring unit 22 between longitudinal sides is translated into a mattress 20 that crowns between its longitudinal sides. Likewise, if it is desired to provide a mattress 20 that crowns only between its lateral sides, compression members 100 can be used to connect lateral sides 44, 46, 52 and 54 of upper and lower border wires 36 and 38 and foam padding layer 24 can taper as it extends from a central location outwardly toward the lateral sides. This results in a crowning of inner spring unit 22 between the lateral sides and a crowning of foam padding layer 24 between the lateral sides which translates into a crowning of mattress 20 between its lateral sides.

Foam padding layer 24 is a resilient layer that resists compression and desires to go back to its uncompressed state. Foam padding layer 24 can be made from a variety of materials. For example, foam padding layer 24 can be made from a high density or high resiliency urethane foam, either open or closed cell. Preferably, foam padding layer 24 is made from a urethane foam having a density of about 1.8 $lbs/ft^3$ or more.

Figure 4B:
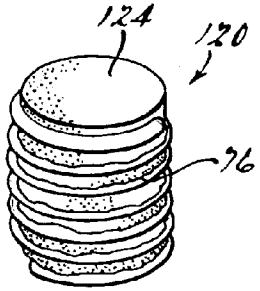
FIGS. 4A–B are side elevation views of a reinforced spring member according to the principals of the present invention in an uncompressed and compressed state respectively.
Figure 4A:
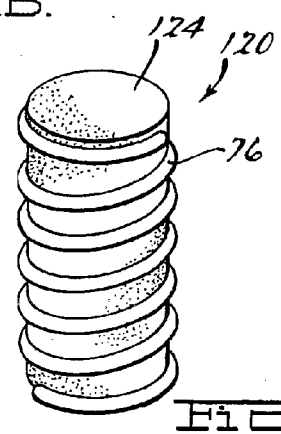

Referring now to FIGS. 4A and B, a reinforced spring member is shown and indicated as 120. Reinforced spring members 120 can be used in a crowned mattress, such as that shown in FIGS. 1–3, in a mattress crowned by other means or methods, and in non-crowned mattresses. Reinforced spring member 120 is a spring member 76 with a resilient member 124 positioned inside of the spring member and engaging with the convolutions of the spring member. Resilient member 124 is generally cylindrical in shape and fits within a cylindrical interior of a spring member 76. Resilient member 124 is compressible but resists compression and adds to the compression resistance of a spring member 76 within which it is employed. That is, a reinforced spring member 120 will have an effective spring rate that is a combination of a spring rate of spring member 76 and a spring rate of resilient member 124. The effective spring rate of reinforced spring 120 is greater than that of an unreinforced spring 76 such that reinforced spring members 120 exhibit a higher resisting force to compression than a spring member 76.

Resilient member 124 can be made from a variety of materials to provide a reinforced spring member 120 having a desired effective spring rate. Preferably, resilient member 124 is made from a closed cell foam that is more rigid than a urethane foam and less rigid than Styrofoam.

Resilient member 124, as shown in FIG. 4A, is dimensioned to extend the entire height of spring member 76. It should be appreciated, however, that the height of resilient member 124 can be less than the height of spring member 76 without departing from the scope of the invention. Resilient member 124 has a diameter that allows resilient member 124 to easily be inserted into an interior of spring member 76. When a reinforced spring member 120 is compressed, as shown in FIG. 4B, resilient member 124 interacts with the convolutions of spring member 76 to provide resistance to the compression of the convolutions thus providing a stiffer or higher effective spring rate for reinforced spring member 120 than that of an unreinforced spring member 76.

Reinforced spring members 120 are used to provide additional support, longevity, and a greater resistance to compression in specific areas of mattress 20. For example, reinforced spring members 120 can be dispersed or scattered throughout an area in which a majority of a load on mattress 20 is expected to be encountered, such as where a person(s) using mattress 20 would be positioned. The portion of mattress 20 provided with reinforced spring members 120 can vary.

Figure 5A:
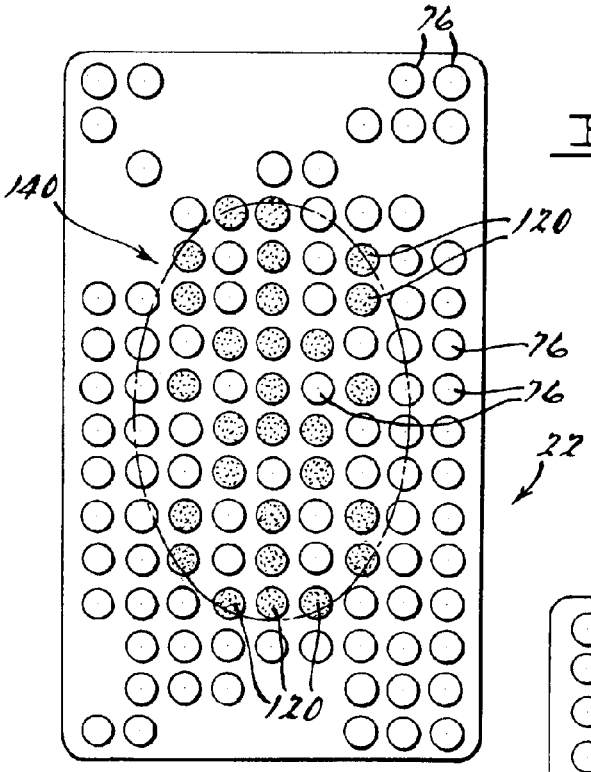
FIGS. 5A–B are simplified partial top views of various configurations of the reinforced spring member placement in a mattress according to the principals of the present invention.
Figure 5B:
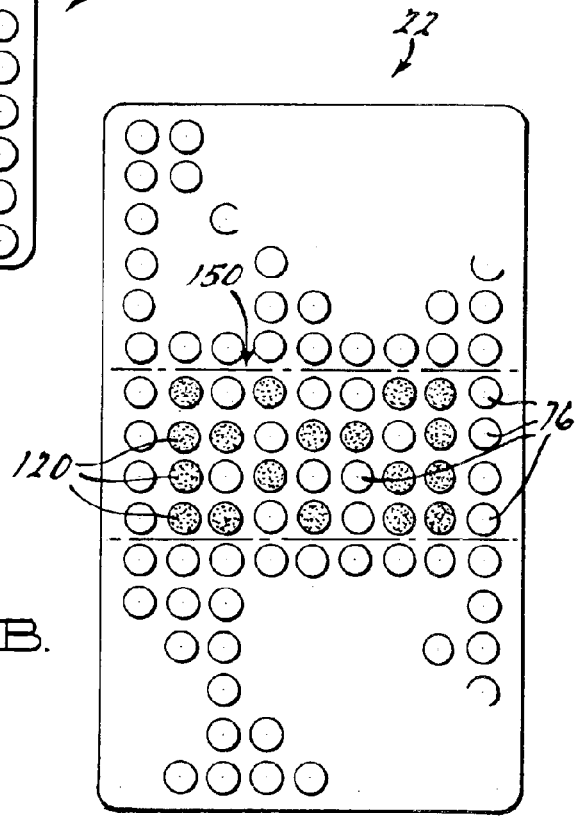

Referring to FIG. 5A, reinforced spring members 120 can be dispersed or scattered throughout a central portion 150 of mattress 20 which is generally oval in shape. As can be seen, not every spring member 76 within central portion 150 is reinforced with a resilient member 124. Rather, reinforced spring members 120 are dispersed or scattered throughout central portion 150 to provide a generally increased resistance to compression in central portion 150 without a harsh or undesirable difference between compression characteristics of central portion 150 and other portions of mattress 20. Similarly, as shown in FIG. 5B, central portion 150 can be a generally rectangular band that extends between the longitudinal sides of mattress 20. Reinforced spring members 120 are scattered or dispersed throughout rectangular band portion 150. Rectangular band portion 150 is dimensioned to correspond to where the hip area of an individual on mattress 20 would be located. Reinforced spring members 120 are not positioned adjacent the longitudinal edges of mattress 20 due to the limited loading expected to be encountered along the peripheral edges. Thus, central portion 150 can be dimensioned and positioned to correspond to where a majority of the mass of an individual(s) on mattress 20 would occur to provide support at the areas where the greatest load is expected to be encountered.

While the crowned mattress 20 of the present invention is shown with both support members 70 and 72 being bowed or crowned, it should be appreciated that mattress 20 can be configured with only one of the support members 70 and 72 being bowed while the other remains substantially planar without departing from the scope of the present invention. Additionally, while the foam layer 24 is shown as tapering toward its peripheral edges to assist in providing the crowned effect, mattress 20 does not require foam padding layer 24 to be tapered to provide a crowned mattress according to the principles of the present invention. Furthermore, it should be appreciated that foam padding layer 24 can be provided on the top and/or bottom of inner spring unit 22 and that foam padding layer 24 does not need to be tapered on both the top and bottom of inner spring unit 22 to be within the scope of the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A mattress comprising:

a cover forming an outer layer; and a frame at least partially enclosed in said cover, said frame comprising:

first and second support members each having a peripheral edge, said first and second support members being spaced apart with said peripheral edges being substantially aligned with one another;

a plurality of compression members connected to aligned portions of said peripheral edges of said support members, said compression members limiting a maximum distance between said connected portions and causing at least one of said first and second support members to be bowed in at least one direction such that central portions of said first and second support members are spaced further apart than said aligned peripheral edges in said at least one direction; and a plurality of spring members disposed between said first and second support members, said spring members resisting compression of said first and second support members toward one another.

2. The mattress of claim 1, wherein a resultant force applied by at least one of said compression members to said connected portions of said peripheral edges is substantially oriented toward an opposing connected portion.

3. The mattress of claim 1, wherein said compression members are cloth strips.

4. The mattress of claim 1, wherein at least one of said first and second support members are bowed in two directions and said two directions are substantially perpendicular.

5. The mattress of claim 4, wherein both of said first and second support members are bowed in said two directions.

6. The mattress of claim 1, wherein each of said support members includes a wire border that defines said peripheral edge and a plurality of stringers that extend between said peripheral edge, and wherein said stringers are bowed in said at least one direction and said spring members are attached to said stringers.

7. The mattress of claim 1, wherein both of said first and second support members are bowed in said at least one direction.

8. A mattress comprising:

a cover forming an outer layer; and a frame at least partially enclosed in said cover, said frame comprising:

first and second substantially planar support members each having a first pair of edges defining a width and a second pair of edges defining a length, said first and second support members being spaced apart with said first pairs of edges substantially aligned and said second pairs of edges substantially aligned;

a plurality of spring members disposed between said first and second support members, said spring members resisting compression of said first and second support members toward one another;

a plurality of compression members connecting at least one of said first and second pairs of edges on said first support member to a respective at least one of said first and second pairs of edges on said second support member, said compression members limiting a maximum distance between said connected edges and causing portions of said support members along said connected edges to be closer together than other portions of said support members and results in a crowning of at least one of said support members between said connected pair of edges.

9. The mattress of claim 8, wherein each of said support members includes a wire border that defines said edges and a plurality of stringers that extend between said edges, and wherein said spring members are attached to said stringers.

10. The mattress of claim 9, wherein said stringers of said first and second support members extend between said connected edges and said stringers on at least one of said first and second support members bow away from said stringers on the other of said first and second support members as said stringers extend from said connected edges toward a midpoint of said grids between said connected edges.

11. The mattress of claim 8, wherein a segment of said plurality of spring members includes a plurality of resilient members that are engaged with a portion of said spring members in said segment and increase an effective spring rate of each engaged spring member in said segment.

12. The mattress of claim 11, wherein said segment is located in said frame at a position substantially corresponding to an expected location of a hip portion of a person lying on said frame.

13. The mattress of claim 8, further comprising first and second resilient members disposed between said cover and said respective first and second support members, said resilient members each having a thickness that tapers such that a central portion of each resilient member is thicker than an edge portion.

14. The mattress of claim 13, wherein said edges portions of said resilient members are adjacent said first and second pairs of edges of said support members.

15. The mattress of claim 8, wherein said compression members connect said first pairs of edges of said support members together and connect said second pairs of edges of said support members together.

16. The mattress of claim 8, wherein said spring members adjacent said at least one pair of connected edges are compressed by said support members.

17. The mattress of claim 8, wherein said spring members are coil springs.

18. The mattress of claim 8, wherein each of said spring members are substantially identical.

19. The mattress of claim 8, wherein all of said spring members are compressed between said support members and spring members adjacent said connected edges are compressed a greater amount than other spring members.

20. The mattress of claim 8, wherein said compression members are woven cloth strips.

21. The mattress of claim 8, wherein both of said support members are crowned between said connected pair of edges.

22. The mattress of claim 8, wherein said compression members form a closed loop around said connected edges.

23. The mattress of claim 8, wherein a resultant force applied by at least one of said compression members between opposing connected edges is substantially planar.

* * * * *